US007481424B2

(12) United States Patent
Park

(10) Patent No.: US 7,481,424 B2
(45) Date of Patent: Jan. 27, 2009

(54) PAPER FEEDING APPARATUS OF PRINTER

(75) Inventor: Jin-ho Park, Gyeonggi-do (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 181 days.

(21) Appl. No.: 10/703,077

(22) Filed: Nov. 7, 2003

(65) Prior Publication Data

US 2004/0135866 A1 Jul. 15, 2004

(30) Foreign Application Priority Data

Dec. 23, 2002 (KR) ..... 10-2002-0082376

(51) Int. Cl.
*B65H 1/00* (2006.01)

(52) U.S. Cl. ..... 271/162

(58) Field of Classification Search ..... 271/276, 271/196, 197, 121, 127, 160, 162, 147, 167, 271/117; 101/419, 488; 400/579, 582; 347/104
See application file for complete search history.

(56) References Cited

U.S. PATENT DOCUMENTS

| | | | | |
|---|---|---|---|---|
| 1,850,108 | A * | 3/1932 | Hunter et al. | 271/161 |
| 3,827,687 | A * | 8/1974 | Kono | 271/117 |
| 5,026,041 | A * | 6/1991 | Kitazume et al. | 271/118 |
| 5,054,759 | A * | 10/1991 | Lohrmann et al. | 271/22 |
| 6,305,683 | B1 * | 10/2001 | Kim | 271/22 |
| 6,308,947 | B1 * | 10/2001 | Kojima et al. | 271/124 |
| 6,337,751 | B1 * | 1/2002 | Kimizuka | 358/498 |
| 6,382,617 | B1 * | 5/2002 | Yen et al. | 271/3.14 |
| 6,478,294 | B2 * | 11/2002 | Hiratani | 271/10.09 |
| 2002/0003332 | A1 * | 1/2002 | Hiratani | 271/121 |
| 2002/0060396 | A1 * | 5/2002 | Tanaka | 271/121 |
| 2003/0062668 | A1 * | 4/2003 | Shibata et al. | 271/121 |

FOREIGN PATENT DOCUMENTS

| | | | |
|---|---|---|---|
| JP | 57-79853 | | 5/1982 |
| JP | 62-140944 | * | 6/1987 |
| JP | 2-70625 | * | 3/1990 |
| JP | 06-286909 | | 10/1994 |

OTHER PUBLICATIONS

Chinese Office Action for Application No. 2003101237124.

* cited by examiner

*Primary Examiner*—Patrick H Mackey
*Assistant Examiner*—Thomas A Morrison
(74) *Attorney, Agent, or Firm*—Staas & Halsey LLP

(57) ABSTRACT

A paper feeding apparatus of a printer having: a paper feeding tray, which is installed on a rear side of the printer, and on which a paper is placed at an inclination; a paper feeding guide, which is positioned along a paper feeding path from a first part of the paper feeding tray, and guides the paper to a feed roller; a pickup roller which, contacts a first side of the paper in the paper feeding tray, is rotated, and transfers the paper; and a pickup roller driving shaft, which rotates and supports the pickup roller. The paper feeding guide is rotated away from the paper feeding path when a first portion of the paper feeding tray is moved in a direction of the paper feeding path.

11 Claims, 7 Drawing Sheets

PAPER FEEDING APPARATUS OF PRINTER

CROSS-REFERENCE TO RELATED APPLICATIONS

This application claims the priority of Korean Patent Application No. 2002-82376, filed on Dec. 23, 2002, in the Korean Intellectual Property Office, the disclosure of which is incorporated herein in its entirety by reference.

BACKGROUND OF THE INVENTION

1. Field of the Invention

The present invention relates to a paper feeding apparatus of a printer, and more particularly, to a paper feeding apparatus of a printer in which paper is stacked at an inclination and supplied to a main body of the printer.

2. Description of the Related Art

In general, a printer includes a paper feeding apparatus to supply a sheet of paper. The paper may be stacked horizontally or at an inclination.

FIG. 1 is a side cross-sectional view illustrating a structure of an ink-jet printer having a conventional paper feeding apparatus, in which paper is stacked at an inclination, and FIG. 2 is a perspective view illustrating the structure of the paper feeding apparatus of FIG. 1.

Referring to FIGS. 1 and 2, a paper feeding tray 20 on which paper P is stacked, is installed on a rear side of a printer main body 10. A sheet of the paper P in the paper feeding tray 20 is supplied to a paper feeding path by a pickup roller 31 and a knock-up plate 22. A knock-up plate spring 28, which elastically biases the knock-up plate 22 upwardly, is installed below the knock-up plate 22. The sheet of the paper P supplied to the paper feeding path, is supplied between a feed roller 40 and a pinch roller 42 via a paper feeding guide 29, and enters into a print zone by driving the feed roller 40. The pinch roller 42 is connected to an end of a pinch roller holder 44, and an other end of the pinch roller holder 44 is connected to a spring 45. The spring 45 presses the pinch roller 42 toward the feed roller 40.

The print zone, where a printing operation is performed on the paper P, corresponds to a printhead 52 of an ink cartridge 50. The ink cartridge 50 is mounted on a carriage return frame 54, and moves perpendicularly to the paper feeding path, along a carriage return shaft 56, by way of a driving unit (not shown). A guide 60, which keeps the paper P flat within the print zone, is installed below the printhead 52. The printed paper P travels along a print path, and is fed between an ejecting roller 62 and a star wheel 64. When the printing operation is completed, the ejecting roller 62 pushes the paper P in a horizontal direction, and ejects the paper P onto an output tray 70.

The paper feeding tray 20 is fixed to the printer main body 10, and a pickup roller driving shaft 33 is rotatably installed perpendicular to the paper feeding path. The pickup roller 31 is rotated by rotation of the pickup roller driving shaft 33. A gear 34 is provided on an end of the pickup roller driving shaft 33 and is driven by a driving unit (not shown).

The paper feeding guide 29 is positioned at a space between a bottom part 21 of the paper feeding tray 20 and the feed roller 40. The paper feeding guide 29 orients the picked-up paper P, so that it feeds horizontally between the feed roller 40 and the pinch roller 42.

But in the paper feeding apparatus having the above structure, when alien substances enter through an opening 11 between the paper feeding tray 20 and the printer main body 10, these alien substances become wedged among the paper feeding guide 29, the feed roller 40, and the pinch roller 42, and thus disturb operation of the printer.

These alien substances may be removed from the printer main body 10 by flipping the printer. But it is not easy to remove them when they are wedged. In addition, they may be removed by disassembling the printer main body 10. It is inconvenient, however, to disassemble the printer main body 10.

Another way to block alien substances is to close an inlet of the opening 11 with an additional cover. However, it is difficult to completely close the opening 11.

SUMMARY OF THE INVENTION

The present invention provides a paper feeding apparatus of a printer having a unit to easily remove alien substances by opening a lower part of a portion of the printer to which these alien substances are adhered.

According to an aspect of the present invention, there is provided a paper feeding apparatus of a printer having a paper feeding apparatus of a printer, the apparatus comprising: a paper feeding tray, which is installed on a first side of the printer, and on which a paper is placed at an inclination to the printer; a paper feeding guide, which is positioned along a paper feeding path from a first part of the paper feeding tray, and guides the paper to a feed roller; a pickup roller, which contacts a first side of the paper in the paper feeding tray, is rotated, and transfers the paper; and a pickup roller driving shaft which rotates and supports the pickup roller, wherein the paper feeding guide is rotated away from the paper feeding path when a first portion of the paper feeding tray is moved in a direction of the paper feeding path.

According to one aspect, the pickup roller driving shaft passes through a sidewall of the paper feeding tray, and is perpendicular to the paper feeding direction; and the paper feeding tray is rotatably installed on the pickup roller driving shaft.

According to one aspect, the apparatus additionally has a protrusion that extends outwardly from sides of the paper feeding tray, wherein the paper feeding tray is rotatably installed on the protrusion.

According to one aspect, the apparatus additionally has a connection unit to fix the paper feeding tray to the main body of the printer during a printing operation.

According to another aspect of the present invention, there is provided a paper feeding apparatus of a printer having: a paper feeding tray, which, is installed on a first side of the printer, and on which a paper is placed at an inclination; a pickup roller, which contacts a first side of the paper in the paper feeding tray, is rotated, and transfers the paper; and a paper feeding guide, which is installed in a direction of a paper feeding path from a first part of the paper feeding tray, and guides the paper to the paper feeding path, wherein the paper feeding guide is rotatably installed on the paper feeding tray, and rotates away from the paper feeding path.

According to one aspect, the apparatus additionally has a protrusion that extends outwardly from one of sides of the paper feeding guide and the first part of the paper feeding tray, wherein the paper feeding guide is rotatably installed on the protrusion.

According to one aspect, the apparatus additionally has a lever that extends from the protrusion and pivots the paper feeding guide.

According to one aspect, the apparatus additionally has: a first gear, which is fixedly installed on the protrusion, a second gear, which is engaged with the first gear; and a lever, which rotates the second gear.

Additional aspects and/or advantages of the invention will be set forth in part in the description which follows and, in part, will be obvious from the description, or may be learned by practice of the invention.

BRIEF DESCRIPTION OF THE DRAWINGS

The above and/or other aspects and advantages of the invention will become apparent and more readily appreciated from the following description of the embodiments, taken in conjunction with the accompanying drawings in which.

DETAILED DESCRIPTION

Figure 1:
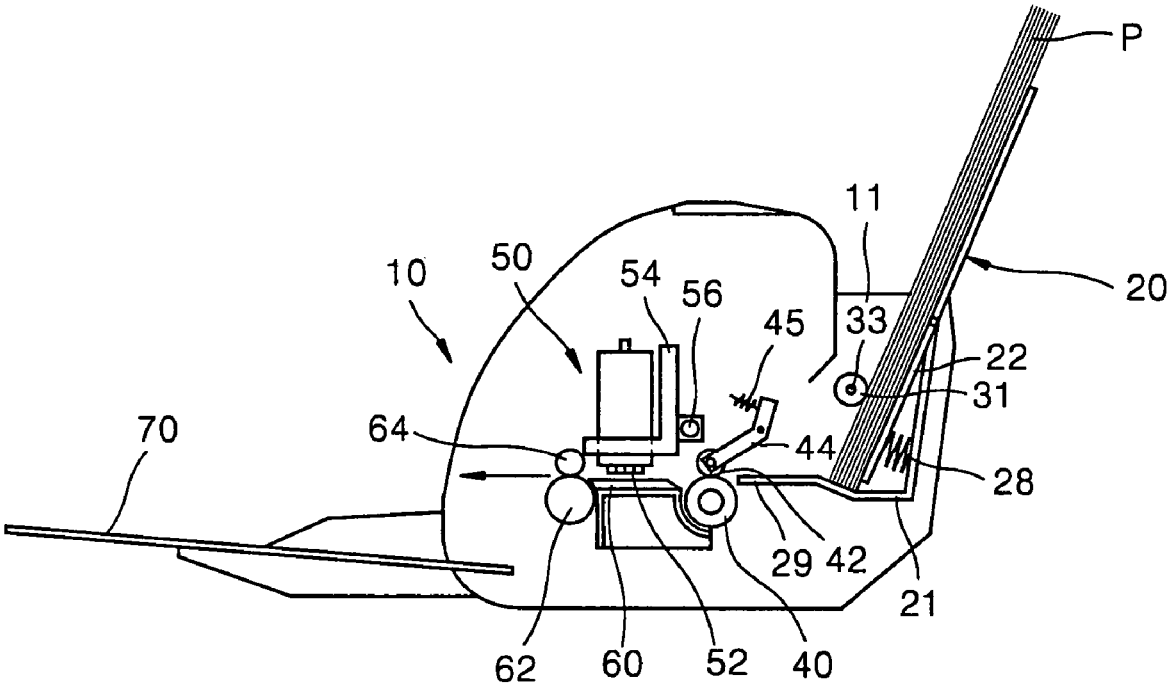
FIG. 1 (PRIOR ART)
FIG. 1 is a side cross-sectional view illustrating a structure of an ink-jet printer having a conventional paper feeding apparatus, in which paper is stacked at an inclination.
Figure 2:
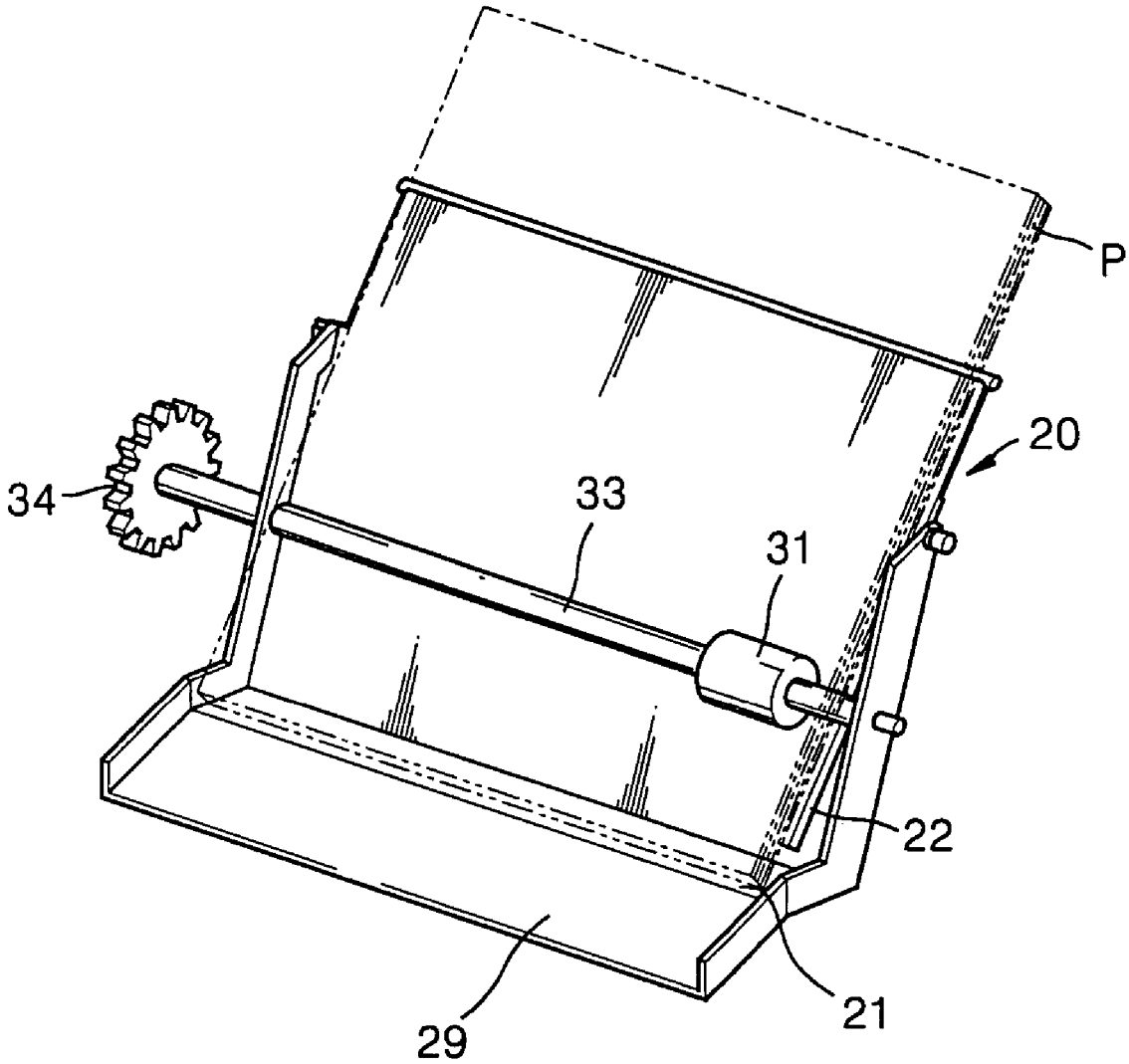
FIG. 2 (PRIOR ART)
FIG. 2 is a perspective view illustrating a structure of a paper feeding apparatus of FIG. 1.

Reference will now be made in detail to the embodiments of the present invention, examples of which are illustrated in the accompanying drawings, wherein like reference numerals refer to the like elements throughout. The embodiments are described below to explain the present invention by referring to the figures.

Figure 3:
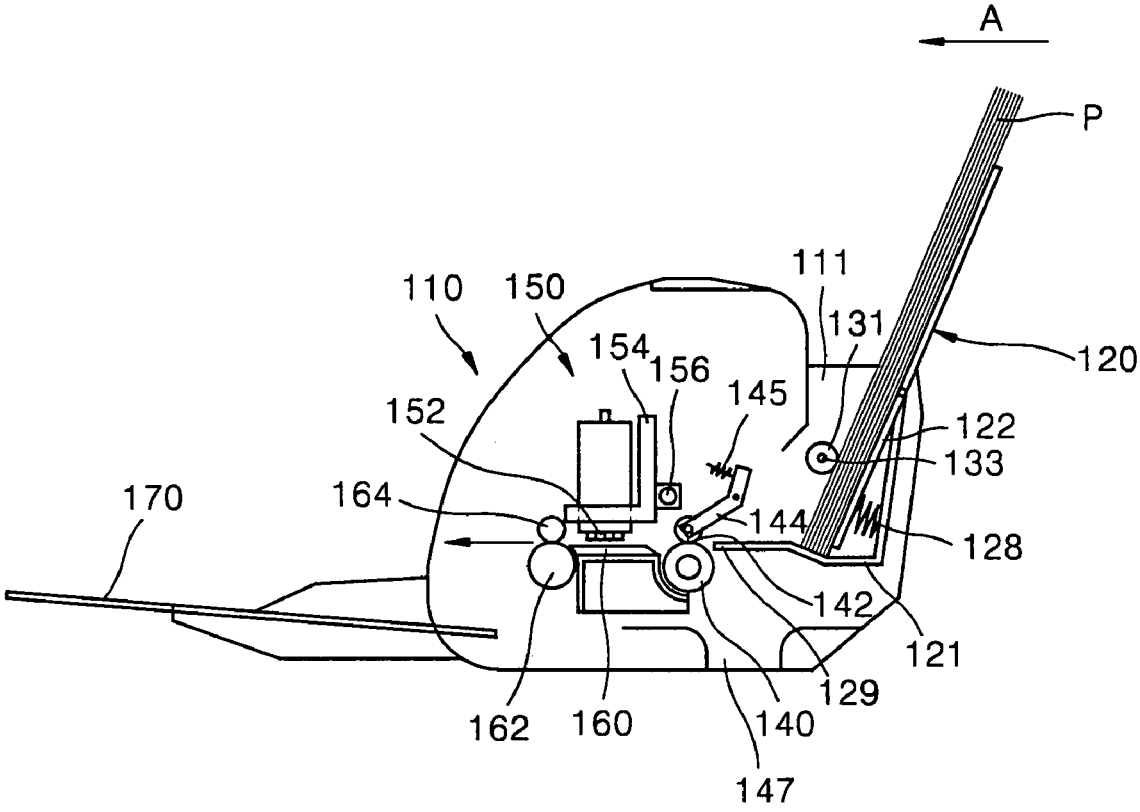
FIG. 3 is a side cross-sectional view illustrating a structure of an ink-jet printer having a paper feeding apparatus according to a first embodiment of the present invention.
Figure 4:
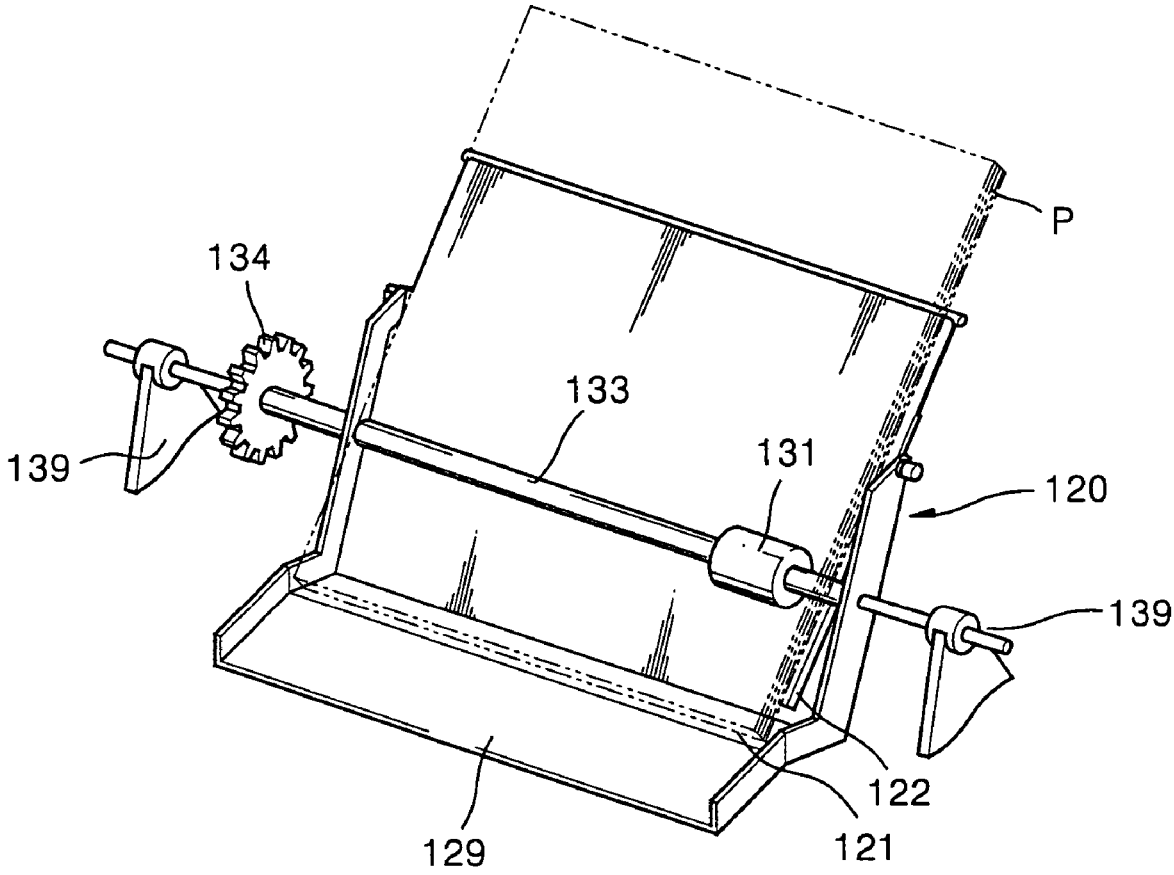
FIG. 4 is a partial perspective view of the paper feeding apparatus of FIG. 3.

FIG. 3 is a side cross-sectional view illustrating a structure of an ink-jet printer having a paper feeding apparatus according to a first embodiment of the present invention, and FIG. 4 is a partial perspective view of the paper feeding apparatus of FIG. 3.

Referring to FIGS. 3 and 4, a paper feeding tray 120, on which paper P is stacked, is installed on a rear side of a printer main body 110. A sheet of the paper P in the paper feeding tray 120 is supplied to a paper feeding path by a pickup roller 131 and a knock-up plate 122. A knock-up plate spring 128, which elastically biases the knock-up plate 122 upwardly, is installed below the knock-up plate 122. A feed roller 140 and an ejecting roller 162 are sequentially disposed downstream of the pickup roller 131 in a print path. A paper feeding guide 129 is positioned at a space between a bottom part 121 of the paper feeding tray 120 and the feed roller 140. The paper feeding guide 129 is fixed to the bottom part 121 of the paper feeding tray 120, and horizontally orients the picked-up paper P between the feed roller 140 and a pinch roller 142. The pinch roller 142, in a pressed state, contacts an upper portion of the feed roller 140. The pinch roller 142 is rotatably connected to an end of a pinch roller holder 144, and an other end of the pinch roller holder 144 is connected to an end of an elastically-biased spring 145, which has an other end fixed to the printer main body 110. Due to an elastic force of the spring 145, the pinch roller 142 presses the paper P between the pinch roller 142 and the feed roller 140, and the paper P is guided into a print zone by the rotation of the feed roller 140.

A printing unit is disposed between the feed roller 140 and the ejecting roller 162. The printing unit includes a guide 160 to keep the paper P supplied to the print path flat, and an ink cartridge 150 to perform a printing operation on the paper P, which is upwardly spaced apart from the fed paper P by a predetermined distance. A printhead 152 ejecting ink on the fed paper P is positioned at a bottom of the ink cartridge 150. The ink cartridge 150 is mounted on a carriage return frame 154, and moves perpendicularly to the print path, along a carriage return shaft 156, by way of a driving unit (not shown). A star wheel 164 contacts an upper portion of the ejecting roller 162, and is rotated, by the rotation of the ejecting roller 162. The printed paper P travels along the print path, and is fed between the ejecting roller 162 and the star wheel 164. When a printing operation is completed the paper P is ejected by the ejecting roller 162 into an output tray 170.

The paper feeding tray 120 is rotatably installed in the printer main body 110. A pickup roller driving shaft 133 is installed in the pickup roller 131, perpendicular to the paper feeding path. The pickup roller 131 is driven and rotated by rotation of the pickup roller driving shaft 133. A gear 134 is provided on one end of the pickup roller driving shaft 133, and is driven by a driving unit (not shown). According to one aspect, a support 139 is installed outside of the paper feeding tray 120 on the pickup roller driving shaft 133, so that the paper feeding tray 120 rotates about the pickup roller driving shaft 133. According to another aspect, the pickup roller driving shaft 133, instead of being supported on the support 139, is rotatably supported in the printer main body 110.

The paper feeding tray 120 extends upwardly from the printer main body 110. As such, if an upper portion of the paper feeding tray 120 exposed outside the printer main body 110 is pushed in a direction A, a paper feeding direction, the paper feeding tray 120 rotates about the pickup roller driving shaft 133. In this case, the paper feeding guide 129, fixed at the bottom part 121 of the paper feeding tray 120, rotates away from the feed roller 140, such that alien substances adhered between the feed roller 140 and the paper feeding guide 129 drop downwardly.

An outlet 147 for these alien substances is positioned under the paper feeding guide 129, and thus, the alien substances are expelled through the outlet 147.

Figure 5:
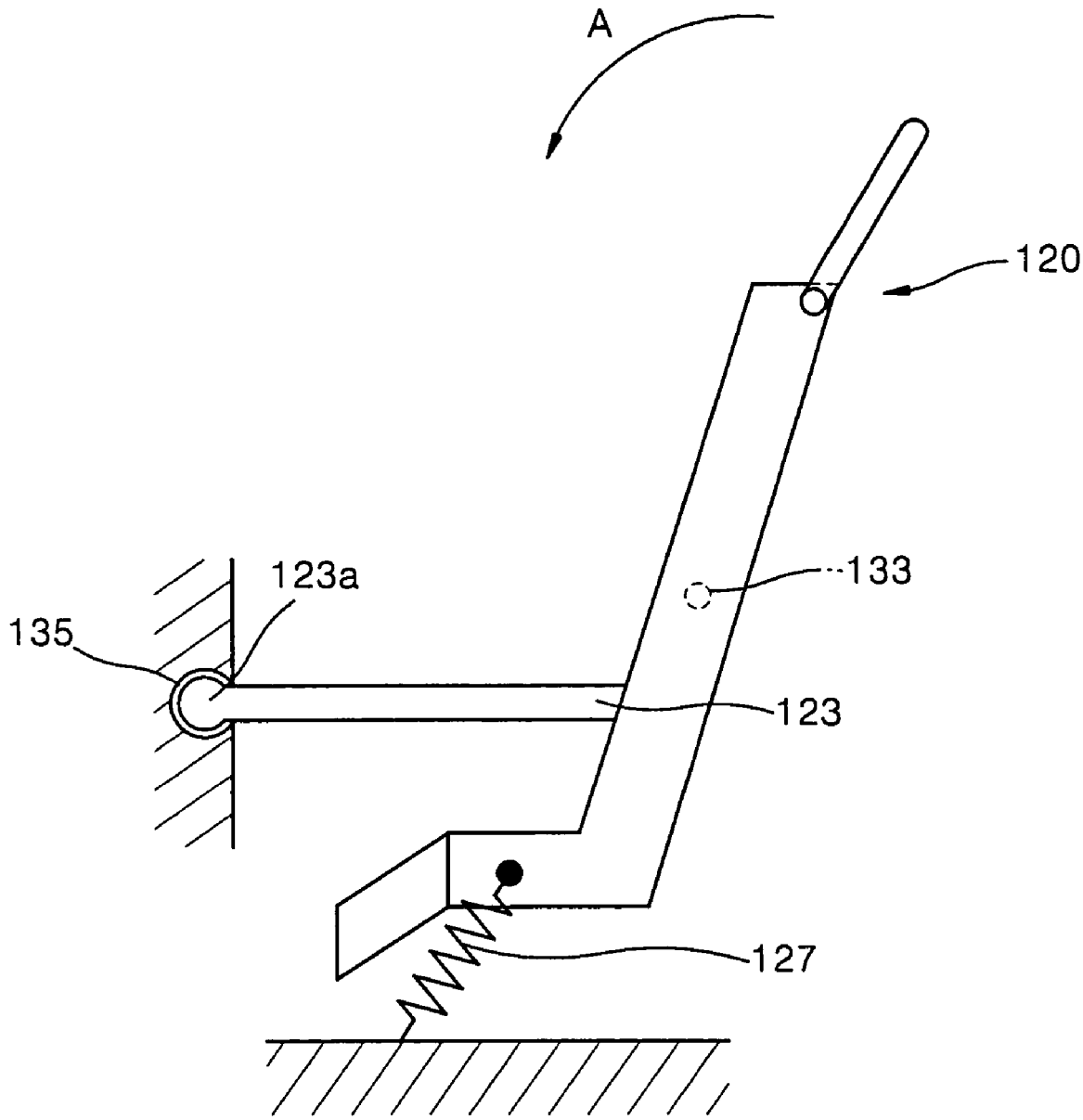
FIG. 5 is a side cross-sectional view illustrating a structure of a unit to fix a paper feeding tray of FIG. 3 to a printer main body.

FIG. 5 is a side cross-sectional view illustrating a structure of a unit to fix the paper feeding tray 20 of FIG. 3 to a printer main body. According to one aspect, a connection member 123 is positioned on a sidewall of the paper feeding tray 120 in the paper feeding direction, and a convex part **123*a* is positioned on an end of the connection member 123. A concave part 135 corresponding to the convex part 123*a* is positioned in the printer main body 110, and thus, the concave part 135 and the convex part 123*a* are combined to create a combined structure to fix the paper feeding tray 120** in a printing position.

According to another aspect, the concave part 135 is positioned on the end of the connection member 123, and the corresponding convex part **123*a* is positioned on the printer main body 110**.

According to yet another aspect, the connection member 123 and the printer main body 110 are detachably connected by a magnet and a metal plate (not shown). According to one aspect, the magnet is positioned on the connection member 123, and the metal plate is positioned on the printer main body 110. According to another aspect, the metal plate is positioned on the connection member 123, and the magnet is positioned on the printer main body 110. According to one aspect, the magnet is an electromagnet.

In addition, an elastic spring 127 is connected between one side of the paper feeding tray 120 and the printer main body 110, and thus biases the paper feeding tray 120 toward the printing position.

The operation of the paper feeding apparatus of a printer having the above structure will be described in detail with reference to the accompanying drawings.

First, the paper P is stacked in the paper feeding tray 120, the pickup roller driving shaft 133 is rotated, the pickup roller 131 is rotated in the paper feeding direction, and a sheet of the paper P is supplied to the print path. During this paper feeding, the convex part **123*a* is engaged with the concave part 135, and thus paper feeding tray 120 is fixed to the printer main body 110**. Then, the printing operation is performed.

Meanwhile, when alien substances enter through an opening 111 between the paper feeding tray 120 and the printer main body 110, a rear side of the upper portion of the paper feeding tray 120 is pushed in the direction A, which is the paper feeding direction. The convex part 123*a* is then detached from the concave part 135, and the paper feeding tray 120 is rotates about the pickup roller driving shaft 133, and the elastic spring 127 is stretched. Then, the alien substances, which were located between the feed roller 140 and the paper feeding guide 129, are expelled through the outlet 147.

Once the alien substances are expelled from the printer main body 110, the paper feeding tray 120 is then released, and due to an elastic force of the elastic spring 127, the paper feeding tray 120 returns to its original position, and the convex part 123*a* is inserted into the concave part 135 and fixed thereto.

In the present embodiment, the pickup roller driving shaft 133 is used as a pivoting shaft for the paper feeding tray 120. According to another aspect, however, by providing a protrusion (see 221 *a* of FIG. 7) that extends from both sides of the paper feeding tray 120, the protrusion is used as the pivoting shaft for the paper feeding tray 120.

Figure 6:
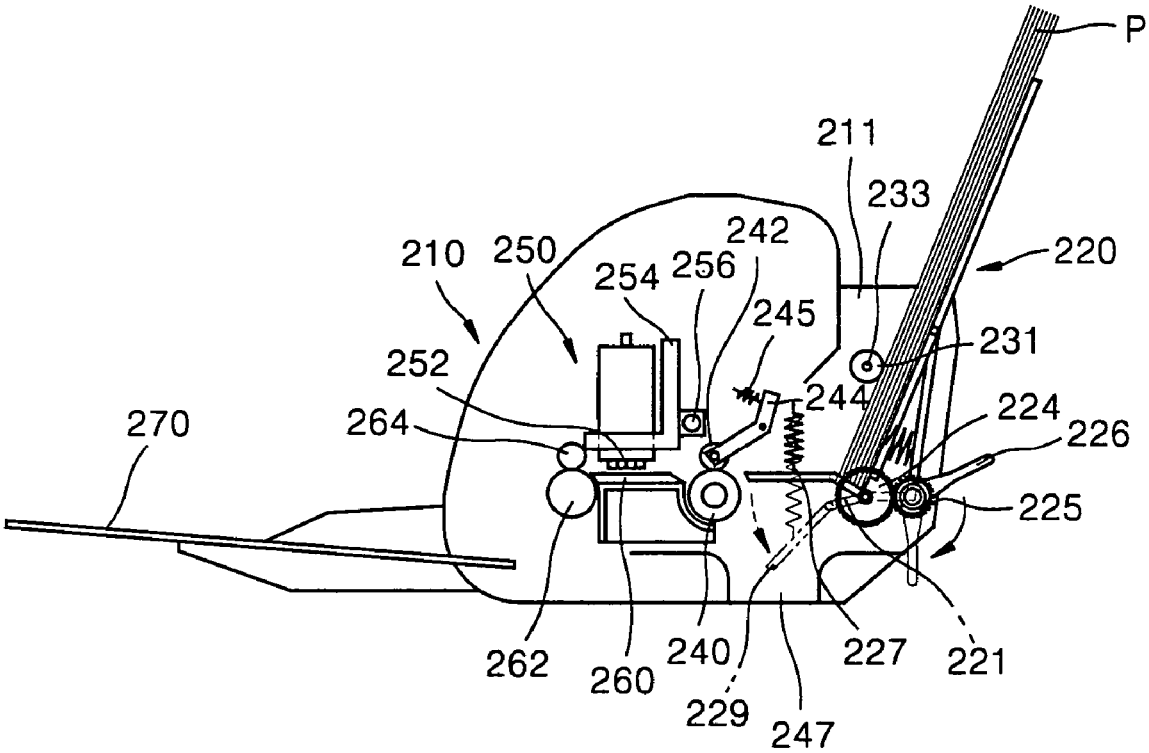
FIG. 6 is a side cross-sectional view illustrating a structure of an ink-jet printer having a paper feeding apparatus according to a second embodiment of the present invention.
Figure 7:
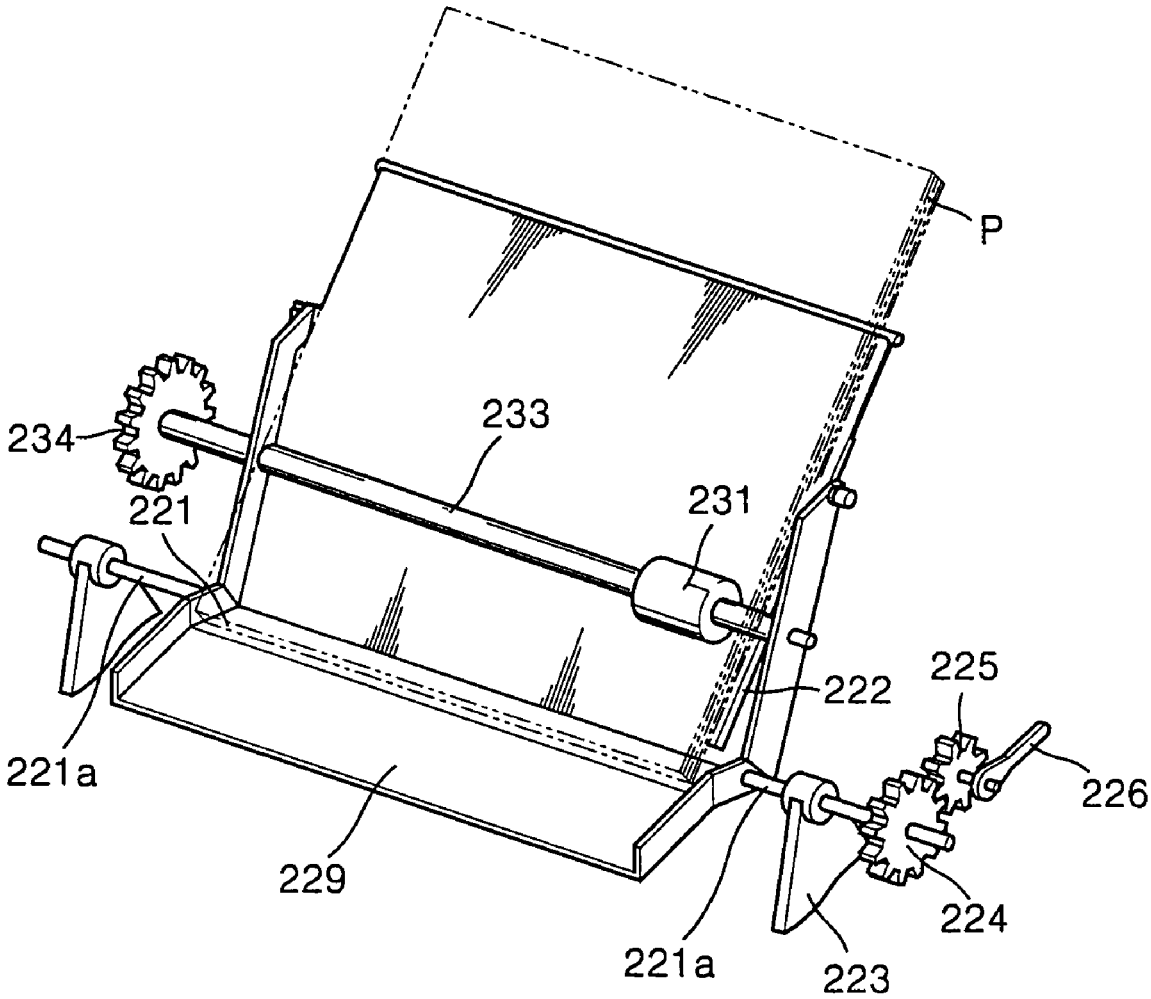
FIG. 7 is a partial perspective view of the paper feeding apparatus of FIG. 6.

FIG. 6 is a side cross-sectional view illustrating a structure of an inkjet printer having a paper feeding apparatus according to a second embodiment of the present invention, and FIG. 7 is a partial perspective view of the paper feeding apparatus of FIG. 6.

Referring to FIGS. 6 and 7, a paper feeding tray 220, on which paper P is stacked, is installed at a rear side of a printer main body 210. A sheet of the paper P in the paper feeding tray 220 is supplied by a pickup roller 231 and a knock-up plate 222 to a paper feeding path. A feed roller 240 and an ejecting roller 262 are sequentially disposed downstream of the pickup roller 231 in a print path. A bottom part 221 of the paper feeding tray 220 is rotatably installed on the paper feeding tray 220. The bottom part 221 extends in the direction of the print path, and has a paper feeding guide 229, which horizontally orients the picked-up paper P between the feed roller 240 and a pinch roller 242. According to one aspect, the paper feeding guide 229 is separately manufactured and fixed to the bottom part 221.

Protrusions 221*a* that extend perpendicularly to a paper feeding direction are respectively positioned at both sides of the bottom part 221. Each protrusion 221*a* is rotatably supported by a support 223 fixed to the printer main body 210. A first gear 224 is disposed on a circumference of the protrusion 221*a*. A second gear 225 is engaged with the first gear 224. The second gear 225 is connected to a lever 226, and when the lever 226 rotates, the first and second gears 224 and 225 rotate. Thus, the bottom part 221 and the paper feeding guide 229 that are fixed to the protrusion 221 *a* rotate downwardly from the paper feeding path when the lever 226 rotates. In this case, a space between the feed roller 240 and the paper feeding tray 220 is opened, and alien substances drop out.

An outlet 247 for these alien substances is positioned under the bottom part 221 and the paper feeding guide 229, and thus, the dropping alien substances are expelled through the outlet 247.

The pinch roller 242, in a pressed state, contacts an upper portion of the feed roller 240. The pinch roller 242 is rotatably connected to one end of a pinch roller holder 244, and an other end of the pinch roller holder 244 is connected to an end of an elastically-biased spring 245, which at an other end, is fixed to the printer main body 210. Due to an elastic force of the spring 245, the pinch roller 242 presses the paper P between pinch roller 242 and the feed roller 240, and the paper P is guided into a print zone by a rotation of the feed roller 240.

A printing unit is disposed between the feed roller 240 and the ejecting roller 262. The printing unit has: a guide 260, to keep the paper P supplied to the print path flat; and an ink cartridge 250, to perform a printing operation on the paper P, which is upwardly spaced apart from the fed paper P by a predetermined distance. A printhead 252 to eject ink on the fed paper P is positioned at a bottom of the ink cartridge 250. The ink cartridge 250 is mounted on a carriage return frame 254, and moves perpendicularly to the print path along a carriage return shaft 256, by way of a driving unit (not shown). A star wheel 264 contacts an upper portion of the ejecting roller 262, and is rotated, by the rotation of the ejecting roller 262. The printed paper P travels along the print path, and is fed between the ejecting roller 262 and the star wheel 264. When the printing operation is completed the paper P is ejected by the ejecting roller 262 onto an output tray 270.

A pickup roller driving shaft 233 is installed in the pickup roller 231, perpendicular to the print path. The pickup roller 231 is rotated by a rotation of the pickup roller driving shaft 233. A gear 234 is provided at one end of the pickup roller driving shaft 233, and is driven by a driving unit (not shown).

An elastic spring 227 is elastically connected between the paper feeding guide 229 and the printer main body 210, such that the bottom part 221 and the paper feeding guide 229 are disposed in predetermined positions when the printer operates. In addition, according to one aspect, combination units 123*a* and 135 shown in FIG. 5 are provided between the bottom part 221 and the printer main body 210.

The operation of the paper feeding apparatus of a printer having the above structure will be described in detail with reference to the accompanying drawings.

First, when a printing operation is performed, the paper P is stacked in the paper feeding tray 220, the pickup roller driving shaft 233 is rotated, the pickup roller 231 is rotated in the paper feeding direction, and a sheet of the paper P is supplied to the print path.

Meanwhile, when alien substances permeate through an opening 211 between the paper feeding tray 220 and the printer main body 210, the lever 226 is pushed downwardly. The bottom part 221 and the paper feeding guide 229 rotate downwardly centering on the protrusion 221 *a* by the rotation of the first and second gears 224 and 225, and the elastic spring 227 is stretched. Subsequently, the alien substances that were located between the feed roller 240 and the paper feeding tray 220 are expelled through the outlet 247.

Once the alien substances are expelled from the printer main body 210 and then the lever 226 is released, due to an elastic force of the elastic spring 227, the paper feeding guide 229 and the bottom part 221 return to their original positions. Due to the rotation of the bottom part 221, the first gear 224, the second gear 225, and the lever 226 also return to their original positions.

As described above, in the paper feeding apparatus of a printer according to an embodiment of the present invention, when alien substances enter the printer and engage an apparatus, such as a roller on a print path, the alien substances can be easily removed from the printer.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A paper feeding apparatus of a printer, the apparatus comprising:

a paper feeding tray which is installed on a first side of the printer, and on which a paper is placed at an inclination to the printer;

a paper feeding guide, which is positioned along a paper feeding path, extends fixedly from a first part of the paper feeding tray, and guides the paper to a feed roller;

a pickup roller, which contacts a first side of the paper in the paper feeding tray, is rotated, and transfers the paper; and a pickup roller driving shaft which rotates and supports the pickup roller, wherein the paper feeding guide is rotated away from the paper feeding path when a second part of the paper feeding tray, opposite the first part, is moved in a direction of the paper feeding path, the pickup roller driving shaft passes through a sidewall of the paper feeding tray, and is perpendicular to the paper feeding direction, and the paper feeding tray is rotatably installed on the pickup roller driving shaft.

2. A paper feeding apparatus of a printer, the apparatus comprising:

a paper feeding tray, which, is installed on a first side of the printer, and on which a paper is placed at an inclination, the paper feeding tray having an upper part and a lower part rotatably installed on the upper part;

a pickup roller, which contacts a first side of the paper in the paper feeding tray, is rotated, and transfers the paper;

a paper feeding guide, which is installed in a direction of a paper feeding path, extending fixedly from the lower part of the paper feeding tray, and guides the paper on the paper feeding path between a feed roller and a pinch roller;

means for rotating the paper feeding guide and the lower part away from the paper feeding path; and an outlet, which is positioned adjacent to the paper feeding guide, and through which alien substances in the paper feeding path are expelled from the printer when the paper feeding guide is rotated away from the paper feeding path.

3. The apparatus of claim 2, further comprising:

a pair of protrusions that extend outwardly from opposite sides of the lower part of the paper feeding tray, wherein thelower part is rotatably installed on the protrusions.

4. The apparatus of claim 3, further comprising:

a lever that extends from one of the protrusions and pivots the paper feeding guide.

5. The apparatus of claim 3, further comprising:

a first gear, which is fixedly installed on one of the protrusions;

a second gear, which is engaged with the first gear; and a lever, which rotates the second gear.

6. The apparatus of claim 2, further comprising:

a connection unit to fix the paper feeding tray to a main body of the printer during a printing operation.

7. A paper feeding apparatus of a printer, the apparatus comprising:

a paper feeding tray, which, is installed on a first side of the printer, and on which a paper is placed at an inclination, the paper feeding tray having an upper part and a lower part rotatably installed on the upper part;

a pickup roller, which contacts a first side of the paper in the paper feeding tray, is rotated, and transfers the paper;

a paper feeding guide, which is installed in a direction of a paper feeding path, extending fixedly from the lower part of the paper feeding tray, and guides the paper on the paper feeding path between a feed roller and a pinch roller;

a connection unit to fix the paper feeding tray to a main body of the printer during a printing operation; and means for rotating the paper feeding guide and the lower part away from the paper feeding path, wherein the connection unit is an elastic spring that is connected between the paper feeding tray and the main body of the printer.

8. A paper feeding apparatus of a printer including a main body, the apparatus comprising:

a paper feeding tray, in which a paper is placed;

supports fixed to the main body;

a paper feeding guide to guide the paper from the paper feeding tray along a paper feeding path, the paper feeding guide being rotatably installed in the main body via the supports, to rotate away from the paper feeding path to free a foreign substance from the paper feeding path; and a connection member to fix the paper feeding guide in a first position during a printing operation, wherein a first end of the connection member is connected with one of the paper feeding guide or the main body, and a second end of the connection member is detachably connected with the remaining one of the paper feeding guide or the main body.

9. The apparatus according to claim 8, wherein:

one of the second end of the connection member or the remaining one of the paper feeding guide or the main body comprises a magnet; and the remaining one of the second end of the connection member or the remaining one of the paper feeding guide or the main body comprises a metal plate.

10. The apparatus according to claim 9, wherein:

the magnet is an electromagnet.

11. A paper feeding apparatus of a printer including a main body, the apparatus comprising:

a paper feeding tray in which a paper is placed, the paper feeding tray having a first part and a second part rotatably installed on the first part;

supports fixed to the main body;

a paper feeding guide, extending fixedly from the second part to guide the paper from the paper feeding tray along a paper feeding path and rotate away from the paper feeding path to free a foreign substance from the paper feeding path; and a pair of protrusions extending from the second part and rotatably connecting the supports and the second part.

* * * * *

UNITED STATES PATENT AND TRADEMARK OFFICE

CERTIFICATE OF CORRECTION

PATENT NO. : 7,481,424 B2
APPLICATION NO. : 10/703077
DATED : January 27, 2009
INVENTOR(S) : Jin-ho Park It is certified that error appears in the above-identified patent and that said Letters Patent is hereby corrected as shown below:

Column 7, Line 38, change “thelower” to --the lower--.

Signed and Sealed this

Thirty-first Day of March, 2009

JOHN DOLL
*Acting Director of the United States Patent and Trademark Office*